US006403870B2

(12) United States Patent
Aoki

(10) Patent No.: US 6,403,870 B2
(45) Date of Patent: Jun. 11, 2002

(54) APPARATUS AND METHOD FOR CREATING MELODY INCORPORATING PLURAL MOTIFS

(75) Inventor: Eiichrio Aoki, Hamamatsu (JP)

(73) Assignee: Yahama Corporation (JP)

( * ) Notice: Subject to any disclaimer, the term of this patent is extended or adjusted under 35 U.S.C. 154(b) by 0 days.

(21) Appl. No.: 09/907,839

(22) Filed: Jul. 18, 2001

(30) Foreign Application Priority Data

Jul. 18, 2000 (JP) ..... 12-216979

(51) Int. Cl.[7] ..... A63H 5/00; G04B 13/00; G10H 7/00

(52) U.S. Cl. ..... 84/609; 84/614

(58) Field of Search ..... 84/609–614, 634–638, 84/649–652, 666–669

(56) References Cited

U.S. PATENT DOCUMENTS 5,155,286 A * 10/1992 Saito et al. ..... 84/611
5,182,414 A * 1/1993 Takahashi
6,080,926 A * 6/2000 Matsuda ..... 84/611 X
6,124,543 A 9/2000 Aoki ..... 84/609
6,245,984 B1 6/2001 Aoki et al. ..... 84/611

* cited by examiner

*Primary Examiner*—Jeffrey Donels
(74) *Attorney, Agent, or Firm*—Rossi & Associates

(57) ABSTRACT

A plurality of melody motifs are provided to be incorporated in a melody to be created. The melody motifs are allotted and located at a plurality of positions along the length of a melody to be created. The length of a melody may be divided into plurality of melody blocks, and each of the melody motifs may be allotted to each of the melody blocks. Each of the located melody motifs is developed to make a melody fraction for the remaining positions in the length of a melody. The located melody motifs and the developed melody fractions in combination constitute the melody to be created. Musical characters for the respective melody blocks may be designated so that the development of the melody motif is conducted also with reference to the designated characters. A melody block may consist of a plurality of musical sentences, and the melody motif for this melody block is located at one of the sentences. The degrees of similarity among the sentences of a melody to be created are designated in terms of musical properties, and melody fractions for the respective sentences are developed from the given melody motif with reference to the degrees of sentence similarity.

15 Claims, 4 Drawing Sheets

*Fig. 2* Example of Melody Structure

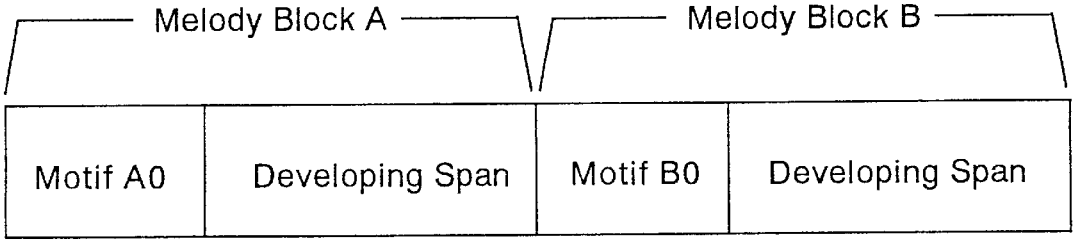

*Fig. 3* Example of Melody Characters

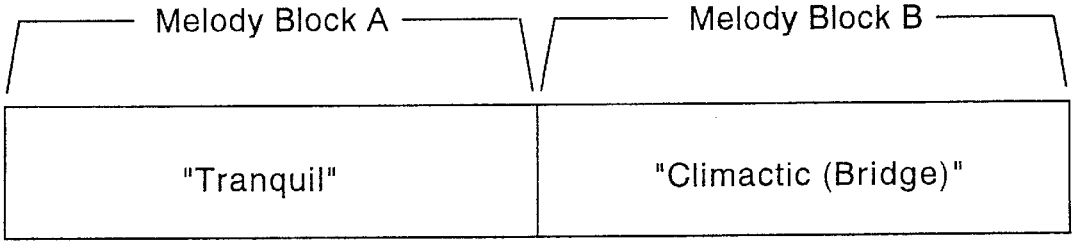

*Fig. 4* Examples of Characteristic Data for Melody Creation per Character

| Character | Characteristics Data for Creating Block Melody |
|---|---|
| Tranquil | Pitch: Narrow Variation Range, Lower Note Range<br>Rhythm: Without Syncopation, Few Notes<br>Chord Progression: Few Tension Notes |
| Climactic (Bridge) | Pitch: Wide Variation Range, Higher Note Range<br>Rhythm: With Syncopation, Many Notes<br>Chord Progression: Many Tension Notes |
| : | : |

*Fig. 5* Example of Developing Motif

Block (e.g. Melody Block A)

| Sentence Structure | a | | a' | | b | | a | |
|---|---|---|---|---|---|---|---|---|
| Motif Development | for 1st Half Give Motif | for 2nd Half Create Anew | for 1st Half Half Copy Motif | for 2nd Half Half Create Anew | for 1st Half Half Create Anew | for 2nd Half Half Create Anew | for 1st Half Half Copy Motif | for 2nd Half Half Copy 2nd Half of <a> |

APPARATUS AND METHOD FOR CREATING MELODY INCORPORATING PLURAL MOTIFS

BACKGROUND OF THE INVENTION

1. Field of the Invention

The present invention relates to a melody creating apparatus and method, and a machine readable medium containing program instructions for realizing such an apparatus and a method, and more particularly to an apparatus and a method for creating a length of melody, in which different melody motif pieces are provided and are placed at different positions along the length of a melody to be created, and are respectively developed to create melody fractions for the remaining spans in the length of a melody to be created. Thus, the invention is capable of creating a melody including plural motifs which will give different musical sensations. The invention is applicable in various kinds of electronic musical apparatuses such as an electronic musical instrument, an automatic music composing apparatus, and a computer-system-configured music composing apparatus.

2. Description of the Prior Art

Among various types of melody creating apparatuses known heretofore, there is a type of melody creating apparatus in which a melody motif is given at the top portion of a length of melody and the motif is developed for the succeeding portion to complete a melody having the length of a tune. But, with such a type of apparatus, only a melody motif for the top portion of a tune can be inputted, and no other motifs can be given for the middle or intermediate portions of a tune, and therefore the user's intention cannot be fully reflected for a melody to be created. For example, even if one wishes to make a melody having quiet portions and vivid portions, or slow portions and quick portions in the middle of the melody, one can input only a single motif which may be either quiet or vivid, or either slow or quick, and consequently if one inputs a motif having a character of being quiet and slow, a melody having tranquility and slowness can be created, but a melody having a vividness and quickness will not always be obtained.

SUMMARY OF THE INVENTION

It is, therefore, a primary object of the present invention to provide a melody creating apparatus and method and a machine readable medium containing a program therefor capable of creating a length of melody which will reflect user's intention to include different and even opposing musical characters.

According to the present invention, the object is accomplished by providing a musical apparatus for creating a length of melody based on a plurality of given melody motifs, the apparatus comprising: a melody motif provider which provides a plurality of melody motifs; a melody motif locater which locates the plurality of melody motifs at a plurality of positions along the length of a melody to be created; and a melody fraction developer which develops each of the located melody motifs to make a developed melody fraction for each of the remaining positions other than the positions where the melody motifs have been located along the length of a melody to be created, the located melody motifs and the developed melody fractions in combination constituting the melody to be created.

According to an aspect of the present invention, the melody creating apparatus is to create a length of melody consisting of a plurality of melody blocks; each of the plurality of positions at which the plurality of melody motifs are located is determined within each of the plurality of melody blocks; and the melody fraction developer develops each melody motif located within each melody block to make a developed melody fraction for the remaining positions within each melody block.

According to another aspect of the present invention, the melody creating apparatus further comprises a melody character designator which designates a character for each of the melody blocks; and wherein the melody fraction developer develops each melody motif within each melody block based on the designated character for each melody block to make a developed melody fraction for each melody block.

According to a further aspect of the present invention, the melody creating apparatus is to create a length of melody including at least one melody block which consists of a plurality of musical sentences, and the melody motif located in such at least one melody block is located at one of the plurality of musical sentences; the apparatus further comprises a sentence similarity designator which designates degrees of similarity in terms of musical properties among the musical sentences to be created, the degrees of similarity indicating at least whether the sentences are identical or similar or different from one to another; and the melody fraction developer develops the melody motif located on such at least one melody block based on the designated degrees of similarity to make a developed melody fractions for the respective musical sentences.

According to a still further aspect of the present invention, the melody fraction developer develops the melody motif located on the melody block by copying the melody motif located at the one musical sentence for other sentences which are designated to be identical or similar to the sentence at which the melody motif is located in making the developed melody fractions.

According to the present invention, the object is further accomplished by providing a method for creating a length of melody based on a plurality of given melody motifs, the method comprising: a step of providing a plurality of melody motifs; a step of locating the plurality of melody motifs at a plurality of positions along the length of a melody to be created; and a step of developing each of the located melody motifs to make a developed melody fraction for each of the remaining positions other than the positions where the melody motifs have been located along the length of a melody to be created, the located melody motifs and the developed melody fractions in combination constituting the melody to be created.

According to a still firther aspect of the present invention, the method is to create a length of melody consisting of a plurality of melody blocks; and each of the plurality of positions at which said plurality of melody motifs are located is determined within each of the plurality of melody blocks; and the step of developing melody fraction develops each melody motif located within each melody block to make a developed melody fraction for the remaining positions within each melody block.

According to a still further aspect of the present invention, the method further comprises a step of designating a character for each of the melody blocks; and wherein the step of developing melody fraction develops each melody motif within each melody block based on the designated character for each melody block to make a developed melody fraction for each melody block.

According to a still further aspect of the present invention, the method is to create a length of melody including at least one melody block which consists of a plurality of musical sentences, and the melody motif located in such at least one melody block is located at one of the plurality of musical sentences; the method further comprises a step of designating degrees of similarity in terms of musical properties among the musical sentences to be created, the degrees of similarity indicating at least whether the sentences are identical or similar or different from one to another; and wherein the step of developing the melody fraction develops the melody motif located on such at least one melody block based on the designated degrees of similarity to make a developed melody fractions for the respective musical sentences.

According to a still further aspect of the present invention, the step of developing the melody fraction develops the melody motif located on the melody block by copying the melody motif located at one musical sentence for other sentences which are designated to be identical or similar to the sentence at which the melody motif is located, in making the developed melody fractions.

According to the present invention, the object is still further accomplished by providing a storage medium storing a program that is executable by a computer for creating a length of melody based on a plurality of given melody motifs, the program comprising: a module for providing a plurality of melody motifs; a module for locating the plurality of melody motifs at a plurality of positions along the length of a melody to be created; and a module for developing each of the located melody motifs to make a developed melody fraction for each of the remaining positions other than the positions where the melody motifs have been located along the length of a melody to be created, the located melody motifs and the developed melody fractions in combination constituting the melody to be created.

According to a still further aspect of the present invention, the program is to create a length of melody consisting of a plurality of melody blocks; and each of the plurality of positions at which the plurality of melody motifs are located is to be determined within each of the plurality of melody blocks; and the module for developing the melody fraction develops each melody motif located within each melody block to make a developed melody fraction for the remaining positions within each melody block.

According to a still further aspect of the present invention, the program may further include a module for designating a character for each of the melody blocks, and wherein the module for developing the melody fraction develops each melody motif within each melody block based on the designated character for each melody block to make a developed melody fraction for each melody block.

According to a still further aspect of the present invention, the program is to create a length of melody including at least one melody block which consists of a plurality of musical sentences, and the melody motif located in such at least one melody block is located at one of the plurality of musical sentences; the program further comprises a module for designating degrees of similarity in terms of musical properties among the musical sentences to be created, the degrees of similarity indicating at least whether the sentences are identical or similar or different from one to another; and the module for developing the melody fraction develops the melody motif located on such at least one melody block based on the designated degrees of similarity to make a developed melody fractions for the respective musical sentences.

According to a still further aspect of the present invention, the module for developing the melody fraction contained in the program develops the melody motif located on the melody block by copying the melody motif located at one musical sentence for other sentences which are designated to be identical or similar to the sentence at which the melody motif is located, in making developed melody fractions.

According to the present invention, the melody motifs may be provided by the user inputting melody motifs manually, and also may be provided by the apparatus automatically generating motif pieces according to some application software containing a music composing algorithm, and further may be downloaded from a server computer via a communication network.

According to the present invention, therefore, a melody containing plural different characters will be created from the given different melody motif pieces.

BRIEF DESCRIPTION OF THE DRAWINGS

For a better understanding of the present invention, and to show how the same may be practiced and will work, reference will now be made, by way of example, to the accompanying drawings, in which:

FIG. 2 is a chart showing the musical structure of an example of a melody to be created according to the present invention;

FIG. 3 is a chart showing an example of local musical characters for a melody to be created according to the present invention;

FIG. 4 is a table showing an example of data sets for defining details of musical properties with respect to the respective musical characters according to the present invention;

FIG. 5 is a chart showing an example of how a motif is incorporated and developed in the course of melody creation according to the present invention.

DESCRIPTION OF THE PREFERRED EMBODIMENTS

<Hardware Configuration>

Figure 1:
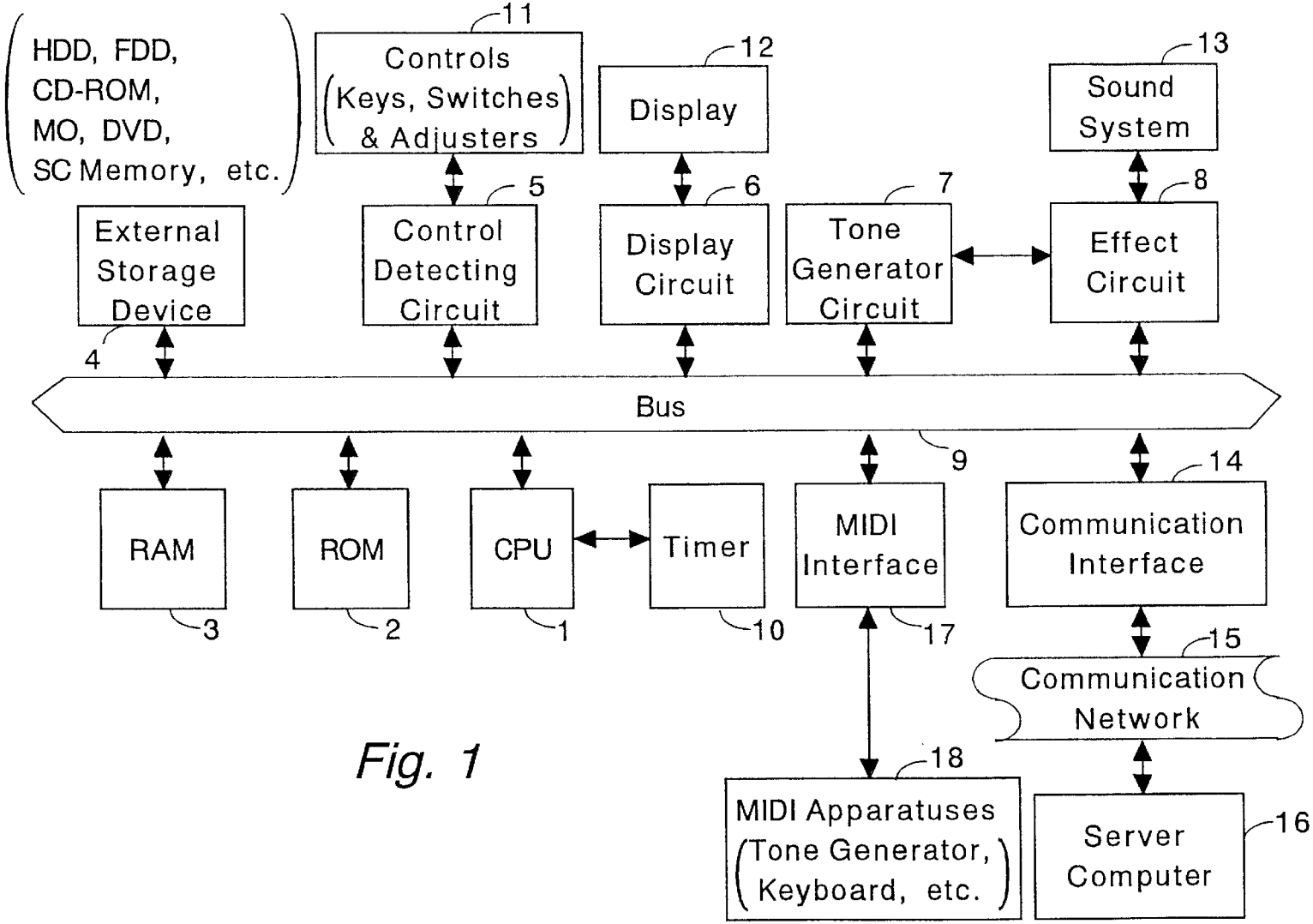
FIG. 1 is a block diagram showing the hardware structure of an embodiment of a melody creating apparatus according to the present invention.

FIG. 1 shows a block diagram of the hardware structure of an embodiment of an automatic music composing system incorporating a melody creating apparatus according to the present invention. The system is configured with a personal computer for performing various kinds of processing including a melody creation engine, an automatic composition engine, etc. The illustrated system comprises a central processing unit (CPU) 1, a read-only memory (ROM), a random access memory (RAM) 2, an external storage device 4, a control detecting circuit 5, a display circuit 6, and also a tone generator circuit 7, an effect circuit 8, which are all connected with each other via a bus 9.

The CPU 1 which is to control the overall system performs various controlling operations according to the associated software programs utilizing a clock signal from a timer 10, and in particular performs the processing of the melody creation engine. The ROM 2 stores control programs to control the system, which may include various programs, various tables and various data associated with the melody creation engine and the automatic composition engine as well as the programs for basic information processing. The RAM 3 stores data and parameters necessary for such processing and also serves as working areas for temporarily storing various registers and flags, and various data during processing.

The external storage device 4 may be a hard disk drive (HDD), or may be any type of storage device utilizing a detachable and portable storage medium such as a compact disc read-only memory (CD-ROM), a floppy disk (FD), a magneto-optical (MO) disk, a digital versatile disk (DVD), a semiconductor memory, and can store various programs and various data so as to provide storage areas, for example, for various melody data files, a chord progression database and parameters for creating a melody of an entire tune or a local melody block. Therefore, the programs and various data and parameters necessary for the processing of melody generation according to the present invention may not only be stored in the ROM 2, but also may be read out from the external storage device 4 and may be transferred into the RAM 3 for the processing. The external storage device 4 may be used for storing the intermediate data or the final results of the processing.

The detection circuit 5 is connected to manipulating devices 11 including a keyboard and a pointing device (e.g. a mouse) to be manipulated by the user for inputting various information to the system. The keys in the keyboard and the controls in the pointing device are assigned with the functions of music-playing manipulator such as a keyboard of an electronic musical instrument and the functions of panel switches for inputting musical information including note pitches and note durations. The performance data for the melody motifs, etc. may, therefore, be inputted to the apparatus in the form of a keyboard play operation or a musical score input operation by means of these music-playing manipulator and panel switches.

The display circuit 6 is connected to a display device 12 and various indicators, and the display 12 exhibits on its screen a cursor and switch buttons which are to be actuated by the controls in the pointing device of the manipulating devices 11. The user can input the musical performance data such as of melody motifs and can conduct various input operations for creating a melody by designating note pitches, note durations, etc. through the operation of the buttons, etc. exhibited on the display 12 using the manipulating devices 11. In addition to the keyboard and the pointing device, a dedicated playing manipulator (a music-playing keyboard) or panel controls (panel switches) may be provided and connected externally, to configure a system in which various musical performance information including musical performance data for melody motifs, etc. and various control information can be inputted as desired.

The tone generator circuit 7 is connected to the effect circuit 8 which may be constituted by a DSP (digital signal processor), and then to a sound system 13 including a loudspeaker, so that the user can listen and audit the music which is performed by reading out a created melody stored in the RAM 3, etc.

In this embodiment, to the bus 9 is also connected a communication interface (I/F) 14 for further connection to a server computer 16 or other remote apparatuses such as PCs and portable communication terminals via a communication network such as telephone lines, so that control programs or other necessary data can be downloaded from such remote apparatuses into the aforesaid external storage device 4. Still firther, a MIDI interface (I/F) 17 is connected to the bus 9 so that the system can send and receive various data to and from another MIDI apparatus 18.

Although the embodiment of FIG. 1 is a type which utilizes a personal computer (PC), the system can utilize an electronic musical instrument comprising dedicated music-playing manipulators and panel controls, or may be configured by utilizing another type of apparatus having similar processing capability.

<Outline of Melody Creation>

FIGS. 2–5 are charts illustrating how a melody is created by an automatic music composing system according to the present invention, in which FIG. 2 shows the musical structure of an example of a melody to be created by the system. The system is characterized in that a melody of the length of a tune is created by first providing (inputting or generating) melody motifs for a plurality of locations in the length of a tune to be created, and then developing such provided melody motifs. More specifically, a tune to be created is comprised of plural melody blocks, for example, two melody blocks A and B, and melody motifs A0 and B0 are set for respectively intended locations (e.g. head portions) in the respective melody blocks A and B, and then the motifs A0 and B0 will be respectively developed by the system automatically to create the melody pieces (fractions) for the respective blocks A and B. For the purpose of developing a given motif, the system may be so configured that characteristic features of the respective blocks of a tune to be created will also be designated, and the melody pieces will be created based on the designated characters as well as the given motifs.

In the present invention, a tune to be created generally consists of plural melody blocks. The example of FIG. 2 is comprised of two melody blocks, one being a melody block A having the melody motif A0 as its base and the other being a melody block B having the melody motif B0 as its base. The melody block A has a first span having the melody motif A0 and a second span of developing the melody motif A0. The melody block B has a first span having the melody motif B0 and a second span of developing the melody motif B0. The melody pieces for the developing spans are created by developing the respective associated melody motifs. The number of melody blocks may be three or more to constitute a length of tune.

An embodiment of the present invention provides block melody creating data which reflect melody characters designated for the respective melody blocks in addition to the general parameters for the entire melody to be created, such as the tonality key, the meter and block configuration. For example, in case the characters of the melody to be created are designated respectively for melody blocks A and B as shown in FIG. 2, the system supplies block melody creating data which reflects such characters to the melody creation engine for the creation of melody blocks A and B, and thus the system creates a melody having respectively designated characters for the respective blocks A and B. FIG. 3 shows an example of such local musical characters with respect to the respective melody blocks of a melody to be created. In the example of FIG. 3, a character to be "tranquil" is designated for the melody block A and a character to be "climactic" (bridge portion) is designated for the melody block B, which will realize the creation of a melody having an emotional wave (up-and-down sensation) with a first half of a tranquil (less vigorous) melody portion and a second half of a climactic (more vigorous) melody portion (bridge portion).

The block melody creating data are stored in predetermined areas of the ROM 2 or the external storage device 4 with respect to the respective melody characters, and upon each designation of the character, the corresponding block melody creating data are read out from the ROM 2 or the external storage device 4 to be supplied to the melody creation engine. FIG. 4 shows an example of data sets for defining details of musical properties prepared for the respective musical characters. In FIG. 4, as the block melody creating data for a melody block characterized to be "tranquil", there are prepared pitch characteristic data meaning "a narrow variation range", "a lower note range", etc.; rhythm characteristics data meaning "without syncopation", "few notes", etc.; and chord progression characteristics data meaning "few tension notes", etc. On the other hand, as the block melody creating data for a melody block characterized to be "climactic", there are prepared pitch characteristics data meaning "a wide variation range", "a higher note range", etc.; rhythm characteristics data meaning "with syncopation", "many notes", etc.; and chord progression characteristics data meaning "many tension notes.

In an embodiment of the present invention, melody motifs are inputted for a plurality of positions along the length of a melody to be created, such as the head portion of each melody block. The melody motif may be inputted manually by the user or may be provided by an automatic music composition engine. In the case of manual input by the user, the melody motif may be inputted by actual play on the music playing keyboard or by individual designation of note lengths and note durations using the panel switches in the controls 11, or by loading an existing melody stored in the external storage device 4, or by downloading an existing tune from a server computer 16, or by receiving a file of a melody piece attached to an e-mail from another PC or portable communication terminal.

In the case of automatic composition, a melody motif may be created by an automatic music composition engine based on the inputted melody creating data, i.e. characteristics data for creating a melody piece. Further alternatively, a melody motif can be semi-automatically created by hybridizing the above manual and automatic methods. In the semi-automatic method, for example, the time points and the durations for the notes may be inputted manually and the note pitches may be automatically given according to the associated software, or alternatively, the time points and the duration for the notes may be automatically provided and the note pitches may be given manually by the user. Still further, the note time points, the note durations and the note pitches may be automatically provided once, and the user may thereafter edit the automatically provided data manually. All of these methods of inputting melody motifs may be incorporated in the apparatus and may be subjected to the user's selection. The methods of inputting or providing melody motifs may vary from a span to another among a plurality of spans along the length of a melody to be created. Further, the methods of inputting or providing melody motifs may made selectable by the user for the individual melody spans.

The embodiment of the present invention develops the inputted (including automatically provided) melody motif by referring to a sentence structure to create a length of melody. The sentence structure describes the degrees of similarity among the sentences constituting a melody block, and these data are included in the melody creating parameters for the entire tune. FIG. 5 shows an example of how a motif is incorporated and developed in the course of melody creation for a particular melody block (e.g. melody block A), in which the symbols <a>, <a'> and <b> in the row of "Sentence Structure" indicate the degrees of similarity. The symbol <a> means to be identical to <a>, the symbol <a'> means to be similar to <a>, and the symbol <b> means to be different from <a>.

In FIG. 5, which is the melody block A of FIG. 2, for example, the first sentence is a motif sentence to locate a melody motif therein, and therefore the melody motif is employed as it is for the first half span of the sentence and a new melody fraction will be created based on the block melody creating data and the entire melody creating data for the second half span of the sentence. For the fourth sentence which is designated with a sentence symbol <a>, the contents of the first sentence (i.e. a motif sentence) will be copied.

Now for the second sentence which is designated with a sentence symbol <a'>, the melody motif will be copied for the first half of the sentence, while a new melody fraction will be created for the second half of the sentence based on the block melody creating data and the entire melody creating data. With respect to the similar sentence which is given the symbol <a'>, an alternative way to the motif copy for the first half and the new creation for the second half would be to once copy both the first and the second half (i.e. the entire first sentence) and then to modify the melody piece by shifting pitches of some of the notes or by applying some arithmetical operations (including multiplication of coefficients) to make a similar and not identical melody contents.

For the third sentence which is designated with a sentence symbol <c>, the entire melody piece for this span is created anew based on the block melody creating data and the entire melody creating data without copying the first sentence, both for the first half and the second half of the sentence.

In developing the given motif for the span which requires the creation of a new melody piece, a melody piece will be created anew based on the melody creating data for the block and on the melody creating data for the entire tune as described above. More specifically, a rhythm to be employed will be first established by, for example, selecting from among the rhythm data base a rhythm which meets the conditions as designated by the meter and the rhythm creating data, and then the chord constituent notes in the provided chord progression will be allotted randomly to the important beat notes (usually a note time point at the strong beat, and in case a note time point does not fall on the strong beat, a note near to the strong beat point or a note having a long duration) of the selected rhythm, and the notes in the musical scale of the prevailing tonality key or the notes in the available note scale defined at that time points will be allotted randomly to the less important beat note. In such processing, the note variation range and the note existing region for the melody will also be considered. And, finally, the musical rules will be applied to check the created melody piece is musically acceptable. If there is any notes which do not meet the rules, such notes will be modified or the creation processing will be reattempted.

<Flow of Melody Creation>

Figure 6:
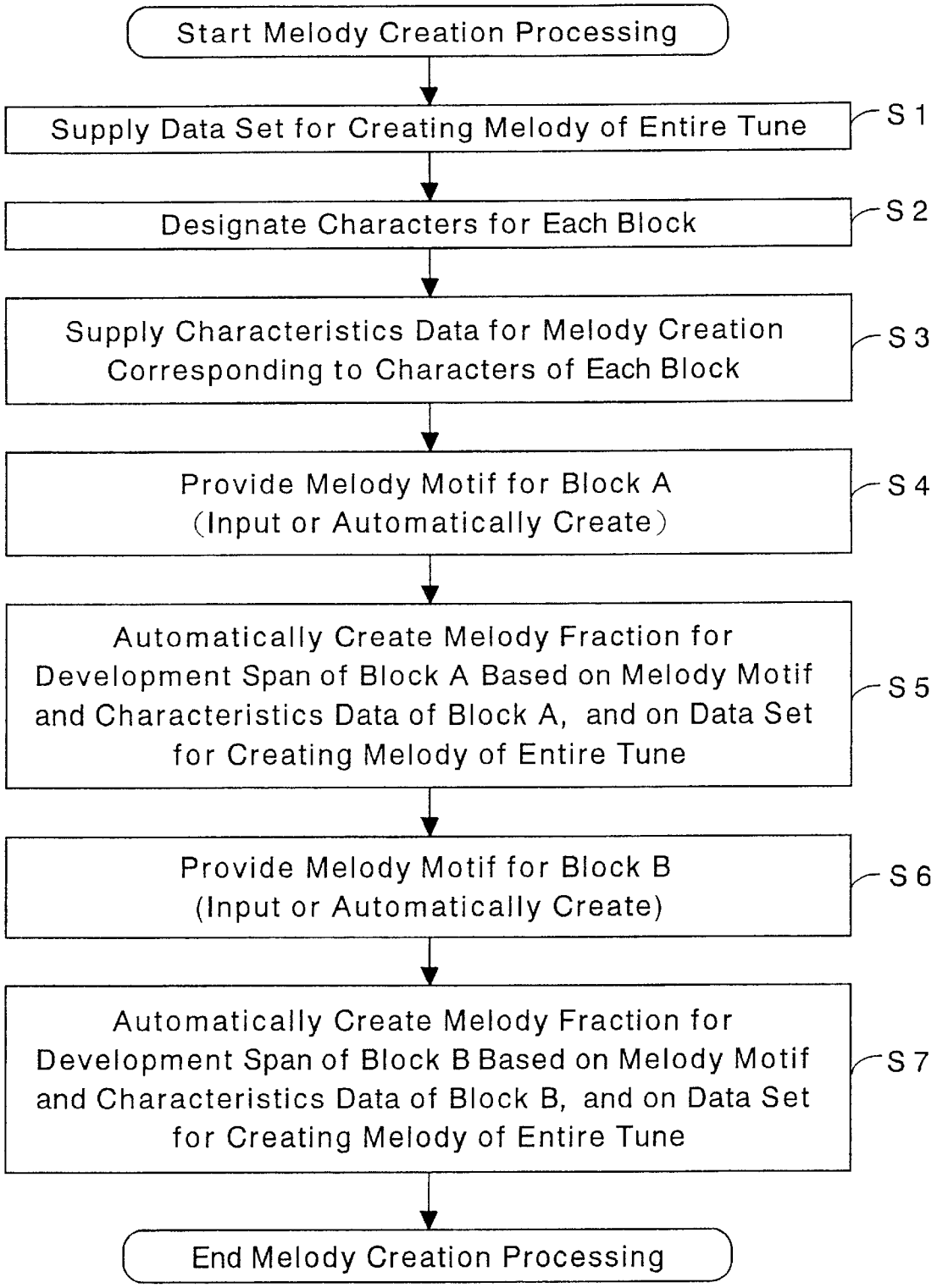
FIG. 6 is a flow chart of a program routine of an example of the melody creation processing according to the present invention.

FIG. 6 is a flow chart describing an example of the melody creation processing according to the present invention. The melody creation processing of this flow corresponds to the case of creating a melody consisting of two melody blocks A and B as shown in FIG. 2. As the melody creation processing starts, a step S1 supplies data sets for creating melody of the entire tune including the tonality key, the meter, the melody block structure, etc. of a melody to be created. These data sets for melody creation may be provided through individual designation of the respective elements or conditions by the user or through selection of a desired set of data from among the previously prepared templates each carrying a set of the data representing the respective elements.

Next, a step S2 is to designate the characters for each melody block. The designation may be conducted by individually designating the characters of the respective melody blocks or by selecting a desired data set from among the previously prepared templates each carrying a set of the data representing the characters of each melody block.

Then, a step S3 supplies the characteristics data for block melody creation corresponding to the characters of each block, and a step S4 provides melody motif A0 for the melody block A by the user's manual inputting operation or by automatic creation by the apparatus. Then, a step S5 automatically creates a melody fraction for the development span of the melody block A based on the melody motif A0 of the melody block A as provided at the step S4, on the characteristics data for block melody creation for the melody block A as supplied at the step S3, and on the data set for melody creation of the entire tune as supplied at the step S1, for instance, by the method as explained above in connection with FIG. 5.

Next, a step S6 provides melody motif B0 for the melody block B by the user's manual inputting operation or by automatic creation by the apparatus. Then, a step S7 automatically creates a melody fraction for the development span of the melody block B based on the melody motif B0 of the melody block B as provided at the step S6, on the characteristics data for block melody creation for the melody block B as supplied at the step S3, and on the data set for melody creation of the entire tune as supplied at the step S1, in a similar manner as explained with reference to FIG. 5. Thus, the processing of melody creation comes to an end. For the case of creating a melody having three blocks or more, the paired processing of inputting or automatically creating a melody motif and of automatically treating a melody fraction for the development span of each additional melody block will be repeated in the number to cover the whole melody blocks.

<Various Modifications>

The present invention has been described herein above with respect to the melody creation processing on a particular embodiment, and the way of the melody creation processing should not be considered to be limited to the above-described embodiment, but may be variously modified according to the knowledge of those having ordinary skill in the art using commonly prevailing technology in this field. For example, the illustrated positions for locating melody motifs are the head portions of the respective melody blocks, where a length of a melody to be created is divided into a plurality of melody blocks, but the positions for placing melody motifs may be determined arbitrarily at other positions in the respective melody block. Further, the motifs may be located at any plural positions along the length of a tune irrespective of the configured melody blocks.

The present invention is also applicable to the melody generation of the types as mentioned below. The provided plurality of melody motifs, for example, melody motifs 1 and 2 may be repeatedly used at plural positions along the length of a tune just as in the sonata form to compose the tune. More specifically, a length of a melody can be constructed in the sequence of an introduction, the motif 1, a passage, the motif 2, a passage, a development by repetitive use of the motifs 1 and 2, a recapitulation of the motif 1, a recapitulation of the motif 2 (as transposed), and then an ending.

In the case where the motifs are provided by automatic creation, the apparatus may be so designed that the user can repeatedly command the apparatus to create motifs up to the user's satisfaction. In the case where the melody motifs are generated automatically for a plurality of positions along the melody to be created, the unsatisfactory motifs may be re-created at the respective individual positions independently, or the once created melody motifs may be re-created all together at the plurality of positions. Further, the individual re-creation and the batch re-creation may be made selectable by the user. Further, in the course of re-creating melody motifs, the parameters for the creation of melody motifs may be made changeable.

In the course of developing the melody motifs to generate melody fractions for the remaining portions, i.e. the development spans, the apparatus may be so designed that the user can repeatedly command the apparatus to develop melody fractions for the development spans up to the user's satisfaction. As to the developed melody fractions for the development spans, the unsatisfactory melody fractions may be re-created at the respective individual development spans independently, or the once created melody fractions may be re-created all together at the plurality of positions. Further, the individual re-creation and the batch re-creation may be made selectable by the user. Further, in the course of re-creating melody fractions for the development spans, the parameters for the creation of melody fractions be made changeable.

With respect to the characters for the melody blocks, one of the characters for the melody blocks is "climactic (bridge)" in the above illustrated embodiment, including the character "bridge" , but the character "bridge" may be made designatable independently from the characters "climactic" and "tranquil", so that both "tranquil" and "bridge" may be designated for the same melody block together.

The melody to be created should not be limited to monophonic (single melody), but may be polyphonic (plural melodies). Further, an accompaniment part may be added, for example, by storing accompaniment style data and developing the accompaniment style data based on the chord progression data. In order to add the accompaniment part, several conventional technology of automatic accompaniment may be available.

The system configuration should not be limited to the form of a personal computer+application software or of an electronic musical instrument, but may be applicable to a karaoke apparatus, a game apparatus, a portable communication terminal such as a cellular phone, a player piano, etc. In the case of application to a portable communication terminal, the invention should be applicable not only to a self-completed terminal device having all necessary functions therein, but also to a combined system with a server computer having some of the functions to perform the overall functions as a server-client system.

When the apparatus is configured in the form of an electronic musical instrument, the type of an electronic musical instrument should not be limited to a keyboard type, but may be of a stringed instrument type, a wind instrument type, a percussion instrument type, or else. The configuration should not be limited to a type which incorporates a tone generator, an automatic playing device, etc. in a single body of the electronic musical instrument, but may be of a type which consists of separate devices for such individual function being connected together using communication means such as MIDI cables and various networks. The communication interface and the communication network may be of a cable connection type and may be of a radio transmission type also. The both communication methods may be employed in a hybrid fashion.

With respect to the MIDI interface, not only the dedicated MIDI interface, but also general-purpose interfaces such as RS-232C, USB (universal serial bus) and IEEE1394. In this case, data other than the MIDI messages may also be transmitted concurrently.

According to the present invention, as the melody motifs are placed (i.e. inputted or generated) at plural positions along the length of a melody to be created, the respective motifs are developed and connected to constitute a tune of melody, which permits the incorporation of both a quiet and slow motif and a vigorous and quick motif, thereby enabling the creation of a melody having up-and-down sensation, thus reflecting the user's preference.

Further according to the present invention, a melody may be constructed by a plurality of melody blocks and the melody motifs may be located at predetermined positions within the respective blocks so that the respective motifs will be developed to make the respective melody fractions for the respective blocks and that the user's intentions (motifs) can be reflected on each of the blocks.

Still further, according to the present invention, the characters for the melody can be designated for the respective blocks where a length of melody is constructed by a plurality of melody blocks, and each of the motifs is to be developed based on the designated characters to create the melody piece for the block. This also enables the creation of a melody in which the user's intention will be reflected block by block.

As will be apparent from the description herein above, some of the structural element devices of the present invention are configured by a computer system performing the assigned functions according to the associated programs. They may of course be hardware structured discrete devices. Therefore, a hardware-structured device performing a certain function and a computer-configured device performing the same function should be considered a same-named device or at least an equivalent to each other.

While particular embodiments of the invention have been described, it will, of course, be understood by those skilled in the art without departing from the spirit that the invention is not limited thereto since modifications may be made by those skilled in the art, particularly in light of the foregoing teachings. It will be understood that the embodiments shown in the drawings and described above are merely for illustrative purposes, and are not intended to limit the scope of the invention. It is therefore contemplated by the appended claims to cover any such modifications that incorporate those features of these improvements in the true spirit and scope of the invention.

What is claimed is:

1. A musical apparatus for creating a length of melody based on a plurality of given melody motifs, the apparatus comprising:

a melody motif provider which provides a plurality of melody motifs;

a melody motif locater which locates said plurality of melody motifs at a plurality of positions along the length of a melody to be created; and a melody fraction developer which develops each of said located melody motifs to make a developed melody fraction for each of the remaining positions other than the positions where said melody motifs have been located along the length of a melody to be created, said located melody motifs and said developed melody fractions in combination constituting the melody to be created.

2. A musical apparatus for creating a length of melody as claimed in claim 1, wherein the melody to be created is a length of melody consisting of a plurality of melody blocks; each of said plurality of positions at which said plurality of melody motifs are located is determined within each of said plurality of melody blocks; and said melody fraction developer develops said each melody motif located within said each melody block to make a developed melody fraction for the remaining positions within said each melody block.

3. A musical apparatus for creating a length of melody as claimed in claim 2, further comprising:

a melody character designator which designates a character for each of said melody blocks; and wherein said melody fraction developer develops said each melody motif within said each melody block based on said designated character for said each melody block to make a developed melody fraction for said each melody block.

4. A musical apparatus for creating a length of melody as claimed in claim 1, wherein the melody to be created is a length of melody including at least one melody block which consists of a plurality of musical sentences, and said melody motif located in said at least one melody block is located at one of said plurality of musical sentences;

said apparatus further comprising: a sentence similarity designator which designates degrees of similarity in terms of musical properties among said musical sentences to be created, said degrees of similarity indicating at least whether the sentences are identical or similar or different from one to another; and wherein said melody fraction developer develops the melody motif located on said at least one melody block based on said designated degrees of similarity to make a developed melody fractions for the respective musical sentences.

5. A musical apparatus for creating a length of melody as claimed in claim 4, wherein said melody fraction developer develops the melody motif located on the melody block by copying said melody motif located at said one musical sentence for other sentences which are designated to be identical or similar to said sentence at which said melody motif is located in making said developed melody fractions.

6. A method for creating a length of melody based on a plurality of given melody motifs, the method comprising:

a step of providing a plurality of melody motifs;

a step of locating said plurality of melody motifs at a plurality of positions along the length of a melody to be created; and a step of developing each of said located melody motifs to make a developed melody fraction for each of the remaining positions other than the positions where said melody motifs have been located along the length of a melody to be created, said located melody motifs and said developed melody fractious in combination constituting the melody to be created.

7. A method for creating a length of melody as claimed in claim 6, wherein the melody to be created is a length of melody consisting of a plurality of melody blocks; each of said plurality of positions at which said plurality of melody motifs are located is determined within each of said plurality of melody blocks; and said step of developing melody fraction develops said each melody motif located within said each melody block to make a developed melody fraction for the remaining positions within said each melody block.

8. A method for creating a length of melody as claimed in claim 7, further comprising:

a step of designating a character for each of said melody blocks; and wherein said step of developing the melody fraction develops said each melody motif within said each melody block based on said designated character for said each melody block to make a developed melody fraction for said each melody block.

9. A method for creating a length of melody as claimed in claim 6, wherein the melody to be created is a length of melody including at least one melody block which consists of a plurality of musical sentences, and said melody motif located in said at least one melody block is located at one of said plurality of musical sentences;

said method further comprising: a step of designating degrees of similarity in terms of musical properties among said musical sentences to be created, said degrees of similarity indicating at least whether the sentences are identical or similar or different from one to another; and wherein said step of developing the melody fraction develops the melody motif located on said at least one melody block based on said designated degrees of similarity to make a developed melody fractions for the respective musical sentences.

10. A method for creating a length of melody as claimed in claim 9, wherein said step of developing the melody fraction develops the melody motif located on the melody block by copying said melody motif located at said one musical sentence for other sentences which are designated to be identical or similar to said sentence at which said melody motif is located, in making said developed melody fractions.

11. A storage medium storing a program that is executable by a computer for creating a length of melody based on a plurality of given melody motifs, the program comprising:

a module for providing a plurality of melody motifs;

a module for locating said plurality of melody motifs at a plurality of positions along the length of a melody to be created; and a module for developing each of said located melody motifs to make a developed melody fraction for each of the remaining positions other than the positions where said melody motifs have been located along the length of a melody to be created, said located melody motifs and said developed melody fractions in combination constituting the melody to be created.

12. A storage medium as claimed in claim 11, wherein the melody to be created is a length of melody consisting of a plurality of melody blocks; each of said plurality of positions at which said plurality of melody motifs are located is determined within each of said plurality of melody blocks; and said module for developing the melody fraction develops said each melody motif located within said each melody block to make a developed melody fraction for the remaining positions within said each melody block.

13. A storage medium as claimed in claim 12, further comprising:

a module for designating a character for each of said melody blocks; and wherein said module for developing the melody fraction develops said each melody motif within said each melody block based on said designated character for said each melody block to make a developed melody fraction for said each melody block.

14. A storage medium as claimed in claim 13, wherein the melody to be created is a length of melody including at least one melody block which consists of a plurality of musical sentences, and said melody motif located in said at least one melody block is located at one of said plurality of musical sentences;

said program further comprising: a module for designating degrees of similarity in terms of musical properties along said musical sentences to be created, said degrees of similarity indicating at least whether the sentences are identical or similar or different from one to another; and wherein said module for developing the melody fraction develops the melody motif located on said at least one melody block based on said designated degrees of similarity to make a developed melody fractions for the respective musical sentences.

15. A storage medium as claimed in claim 14, wherein said module for developing the melody fraction develops the melody motif located on the melody block by copying said melody motif located at said one musical sentence for other sentences which are designated to be identical or similar to said sentence at which said melody motif is located, in making said developed melody fractions.

* * * * *